US005930157A

United States Patent [19]

Matsumoto et al.

[11] Patent Number: 5,930,157

[45] Date of Patent: Jul. 27, 1999

[54] AUTOCORRELATION COEFFICIENT OPERATOR HAVING ANALOG CIRCUIT ELEMENT

[75] Inventors: Ichiro Matsumoto; Changming Zhou; Guoliang Shou, all of Tokyo, Japan

[73] Assignees: Kokusai Electric Co., Ltd.; Yozan Inc., both of Tokyo, Japan

[21] Appl. No.: 08/895,272

[22] Filed: Jul. 16, 1997

[30] Foreign Application Priority Data

Jul. 17, 1996 [JP] Japan ..... 8-206602

[51] Int. Cl.[6] ..... G06J 7/12

[52] U.S. Cl. ..... 364/604

[58] Field of Search ..... 364/604, 606, 364/819, 825, 728.03, 728.07

[56] References Cited

U.S. PATENT DOCUMENTS

| | | | |
|---|---|---|---|
| 4,071,903 | 1/1978 | Head et al. | 364/604 |
| 4,813,006 | 3/1989 | Burns et al. | 364/604 |
| 5,404,320 | 4/1995 | Butler | 364/604 |
| 5,563,819 | 10/1996 | Nelson | 364/825 |
| 5,565,809 | 10/1996 | Shou et al. | 364/606 |
| 5,835,387 | 11/1998 | Shou et al. | 364/606 |

OTHER PUBLICATIONS

"Basics of Phonical Information Processing" Shuzo Saito et al, pp. 115–121, Aum co. Undated.

"Advanced Sound Encryptio Technology for Digital Mobil Telecommunication" pp. 12–15, 42–43, 48–51, 70–75, 116–117, 181–183, Trikepps, Undated.

*Primary Examiner*—Tan V. Mai

*Attorney, Agent, or Firm*—Pillsbury Madison & Sutro LLP

[57] ABSTRACT

The autocorrelation coefficient operator 60 carries out an integration operation to determine the autocorrelation coefficient for audio signal processing or other types of signal processing at high speed with low power consumption. The input signal S is digitized in the A/D converter 30 to the digital signal SP and supplied to a delay unit 40, which delays and holds the digital signal SP sequentially. A sample holder 45 also samples and holds the analog signal S in synchronization with the delay unit 40. When the number of sampled values held by the sample holder 45 reaches a predetermined value, the sample holder 45 outputs the sampled values at the same time in accordance with a sampling clock signal CK which is supplied by a clock signal generator 35. Delayed values held in the delay unit 40 are shifted and output sequentially in accordance with a shift clock signal SCK, the frequency of which is higher than that of the sampling clock signal CK. A weighted addition circuit 50 integrates these sampled values and the delayed values to calculate the autocorrelation coefficient R.

17 Claims, 7 Drawing Sheets

AUTOCORRELATION COEFFICIENT OPERATOR HAVING ANALOG CIRCUIT ELEMENT

BACKGROUND OF THE INVENTION

The present invention claims a priority based on the patent application H8-206602 filed in Japan on Jul. 17, 1996, the content of which is incorporated hereinto by reference.

1. Field of Invention

The present invention generally relates to an autocorrelation coefficient operator for audio signal processing. In particular, the present invention relates to an autocorrelation coefficient operator, which determines an autocorrelation coefficient of an input signal at high speed with low power consumption.

2. Description of Related Art

Various kinds of autocorrelation, such as proximity correlation between sampled values and long run correlation among vowel pitch cycles, are determined in audio signal processing. For example, proximity correlation between sampled values is used for estimating spectrum characteristics of audio signals. Such a process often finds a linear estimate coefficient using an audio autocorrelation, which divides the audio signal by 20 msec (160 samples). Formula (1) shows a general operation for finding the autocorrelation coefficient R(I) of an audio signal with the number N of the sampling values and sampling delay I.

$$R(I) = \sum_{n=0}^{N-1-I} X(n)X(n+I) \tag{1}$$

As the formula (1) shows, a plurality of integration operations is necessary to find the autocorrelation coefficient. The values N and I could be different for different coding methods, and the integration operation may require an enormous number of multiplication and adding operations for large values N and I.

Conventionally, a DSP (Digital Signal Processor) conducts these operations by repeating the multiplication and adding operations. For example, to find the 10th degree autocorrelation when the sampling frequency is 8000 Hz, with a frame length of 20 msec (160 samples), the DSP must conduct 1760 operations, since 160 (integration: tap amount)×11 (shift amount: 0th to 10th)=1760.

As shown above, audio signal processing using an autocorrelation coefficient takes a long time since enormous number of operations must be repeated. Thus, each operation has to be conducted at high speed and the DSP consumes a great amount of power, necessitating in short talking period on portable terminals, such as portable telephones, which use the integration operation for audio signal processing.

SUMMARY OF THE INVENTION

Therefore, it is an object of the present invention to provide an autocorrelation coefficient operator, which can determine the autocorrelation coefficient quickly with low power consumption. It is another object of the present invention to provide an autocorrelation coefficient operator, which determines the autocorrelation coefficient from an input signal quickly with low power consumption.

In order to achieve the above objects, the autocorrelation coefficient operator of the present invention determines the autocorrelation coefficient from an input signal and delayed signals of the input signal by the following steps.

A sample holder samples an input signal such as an audio signal and holds a plurality of sampled values in synchronization with a delay unit. An analog-to-digital converter converts the input signal to a digital signal, which is delayed and held sequentially by a delay unit.

The operation timing controller causes the sample holder to output the sampled values at the same time when the number of sampled values held by the sample holder reaches a predetermined value. The operation-timing controller further causes the delay unit to shift the delayed values and output the delayed values at the same time. The weighted addition circuit calculates and outputs the autocorrelation coefficient by integrating the sampled values output from the sample holder and the delayed values output from the delay unit, every time the delayed values are output from the delay unit.

Preferably, the delay unit and the sample holder operate in accordance with the same sampling clock signal, which is supplied from a clock signal generator provided in the operation timing controller. The operation-timing controller causes the sample holder to output the sampled values at the same time in accordance with the sampling clock signal.

The operation timing controller also generates a shift clock signal, the frequency of which is higher than the frequency produced by multiplying the frequency of the sampling clock signal by the number of values to be sampled by the sample holder. The operation timing controller causes the delay unit to shift the digital signals sequentially within the delay unit, according to the shift clock signal. The digital signals are output from the delay unit at the same time in accordance with the shift clock signal. During one sampling clock cycle, the delayed values are supplied to the weighted addition circuit a predetermined number of times, for determining the autocorrelation coefficient.

The sample holder preferably has the same number of sample holder circuits as the number of values to be sampled by the sample holder. Each sample holder circuit has two switches connected in series, which open and close in opposite directions from each other in accordance with the sampling clock signal. Each sample holder circuit also has two capacitors, which hold the signals output from the switches, respectively, and a buffer, which outputs the signals, held in the capacitors. The input signals supplied to the switches are sampled by the switch operation, and held as the sampled values in parallel.

Preferably, the delay unit has the same number of delay circuits as the number of values to be sampled by the sample holder. The delay circuits, which are connected in series, shift the digital signals to the next delay circuit in synchronization with the shift clock signal, and outputs them at the same time.

The weighted addition circuit preferably has the same number of multipliers as the number of values to be sampled by the sample holder, and an adder, which adds the outputs of the multipliers. Each of the multipliers has the same number of impedance elements as the number of bits of the delayedvalues, for inputting the sampled value in parallel. The multiplier also has a plurality of switches each one being connected to one of the impedance elements, an amplifier which inputs the outputs of the switches, and a feedback impedance element which feeds back the outputs of the amplifier. The multiplier multiplies the sampled values by the delayed values, by inputting the sampled values to each impedance element and controlling each switch operation by the corresponding bit of each of the delayed values.

The above circuit elements of the autocorrelation coefficient operator such as sample holder, delay unit, adder, and multipliers, can be made of analog circuits to reduce the power consumption. In particular, it is preferable to use capacitors for the impedance elements.

DETAILED DESCRIPTION OF THE INVENTION

Figure 1:
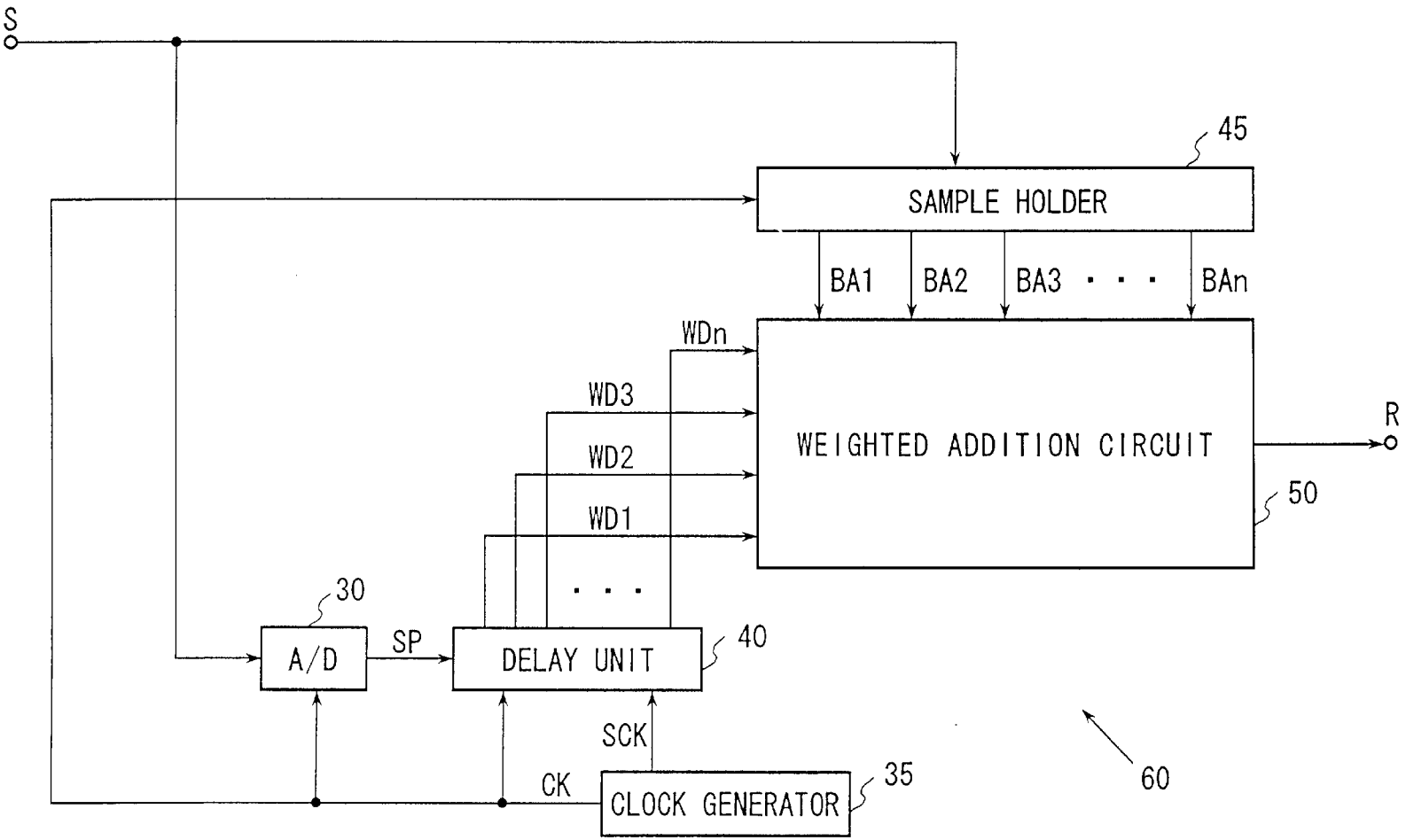
FIG. 1 shows the autocorrelation coefficient operator 60 of the preferred embodiment of the present invention.

The preferred embodiment of the present invention will be explained with reference to the attached drawings. In this embodiment, the present invention is applied to the autocorrelation coefficient operator for analog audio signal processing. As FIG. 1 shows, the autocorrelation coefficient operator 60 samples an analog audio input signal S a predetermined number of times n, where n is an integer greater than 1. The autocorrelation coefficient R is determined according to the above formula (1).

The autocorrelation coefficient operator 60 has a clock signal generator 35, an analog sample holder 45, an A/D converter 30, a delay unit 40, and a weighted addition circuit 50. The clock signal generator 35 generates a sampling clock signal CK having a stable frequency, and a shift clock signal SCK. The frequency of the shift clock signal SCK is higher than that produced by multiplying the frequency of the sampling clock signal CK by the number n.

The analog sample holder 45 samples an input signal S in accordance with the sampling clock signal CK and holds n sampled values BA1 through BAn. The A/D converter 30 samples and digitizes the input signal S to a digital signal SP in accordance with the sampling clock signal CK. The delay unit 40 repeatedly samples the digital signal SP while shifting the sampled digital signals within the delay unit 40, in accordance with the sampling clock signal CK, to hold n delayed values WD1 through WDn of the digital signal SP.

The clock signal generator 35 has an operation timing controller which causes the sample holder 45 to supply the sampled values BA1 through BAn to the weighted addition circuit 50 at the same time in accordance with the sampling clock signal CK. The operation timing controller also causes the delay unit 40 to shift the delayed values WD1 through WDn within the delay unit 40 and output the delayed values WD1 through WDn at the same time, in accordance with the shift clock signal SCK. Since the shift clock signal SCK is faster than the sampling clock signal CK, the delayed values WD1 through WDn can be shifted and supplied to the weighted addition circuit 50 several times, within one cycle of the sampling clock signal CK.

Figure 2:
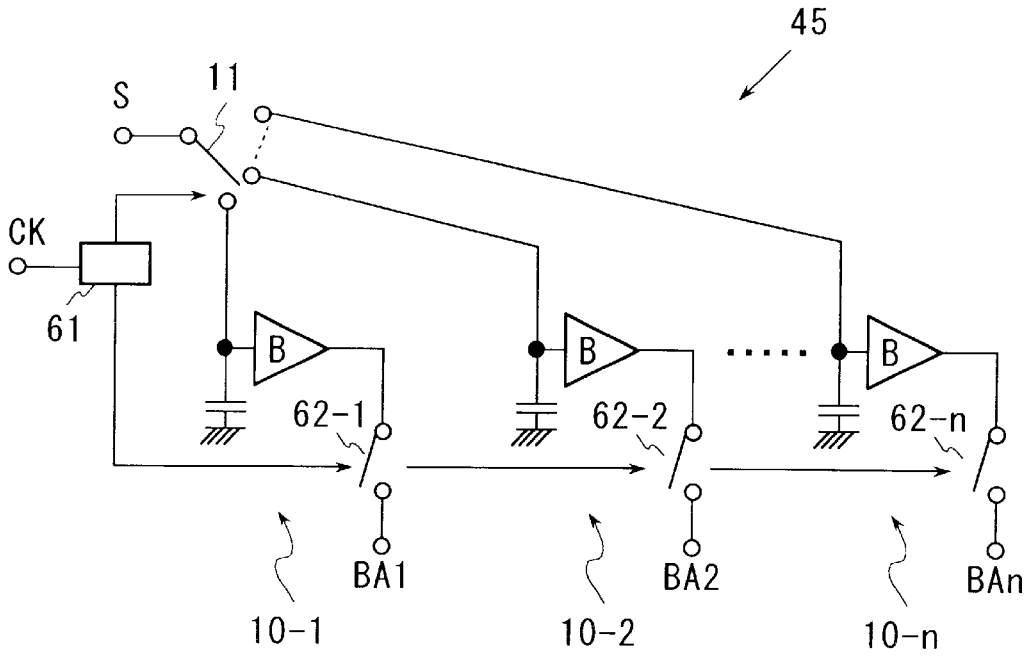
FIG. 2 shows the sample holder 45 of the preferred embodiment.

FIG. 2 shows the analog sample holder 45 in detail. The analog sample holder 45 has n sample holder circuits 10-1 through 10-n, where n is the number of values BA1 through BAn to be sampled. The sample holder 45 further has a switch 11 which distributes the input signal S to the sample holder circuits 10-1 through 10-n in accordance with a control signal supplied from a switch timing controller 61 which operates in accordance with the sampling clock signal CK. The sample holder circuits 10-1 through 10-n sample the input signal S at different times, and output the sample values BA1 through BAn at the same time, when all sample holder circuits 10-1 through 10-n hold the sampled values.

In other words, the first sample holder circuit 10-1 samples the input signal S in synchronization with the first sampling clock signal CK and holds it as the sampled value BA1. The second sample holder circuit 10-2 samples the input signal S in synchronization with the second sampling clock signal CK and holds it as the sampled value BA2. When all sample holder circuits 10-1 through 10-n hold the sampled values BA1 through BAn, the sampled values BA1 through BAn are supplied to the weighted addition circuit 50 at the same time. The switch timing controller 61 also controls the output of the sample holder circuits 10-1 through 10-n by counting the sampling clock signal CK, and the sampled values BA1 through BAn are supplied to the weighted addition circuit 50 at once, when the sampling clock signal CK is counted n times.

Figure 3:
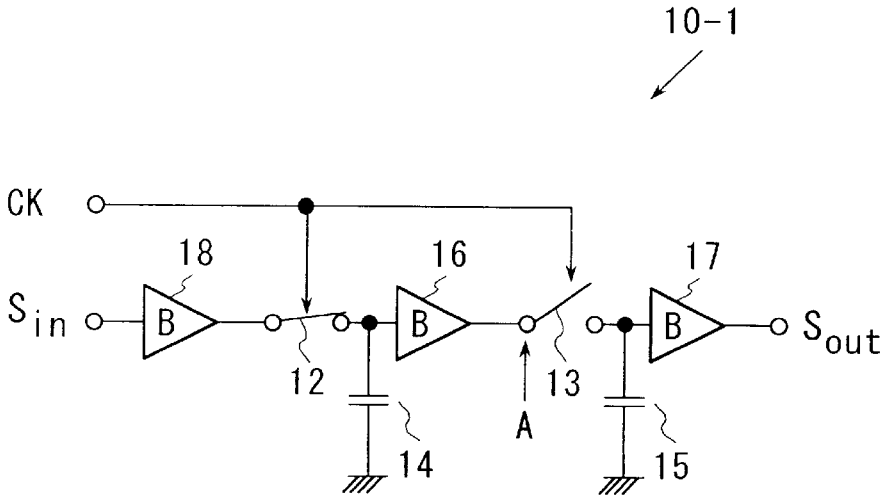
FIG. 3 is an alternate construction of the sample holder circuit 10 of the sample holder 45.

FIG. 3 shows an alternate construction of the sample holder circuit 10-1 shown in FIG. 2. Other sample holder circuits 10-2 through 10-n have the same construction as the sample holder 10-1. In this example, the sample holder circuit 10-1 has an input buffer 19, and two switches 12 and 13 connected in series which open and close in opposite directions from each other according to the sampling clock signal CK. Each sample holder circuit 10-1 through 10-n further has capacitors 14 and 15 which hold the signals supplied from the switches 12 and 13, respectively, and buffers 16 and 17 which output the signals held in the capacitors 14 and 15, respectively. Each sample holder circuit 10-1 through 10-n samples and holds a signal Sin input to the switches 12 and 13 through the input buffer 18 in synchronization with the sampling clock signal CK.

In other words, when the clock signal CK is low, the switch 12 is closed and the signal Sin input through the input buffer 18 is transmitted to the capacitor 14. When the clock signal CK is high, the switch 12 is open and the input signal level is kept in the capacitor 14. The signal level kept in the capacitor 14 is supplied to the capacitor 15 through the buffer 16 when the clock signal CK is high and the switch 13 is closed. The signal level is kept by the capacitor 15 when the clock signal CK is low and the switch 13 is open. The signal held in the capacitor 15 is output as signal Sout to the next sample holder circuit through the output buffer 17.

Figure 4A:
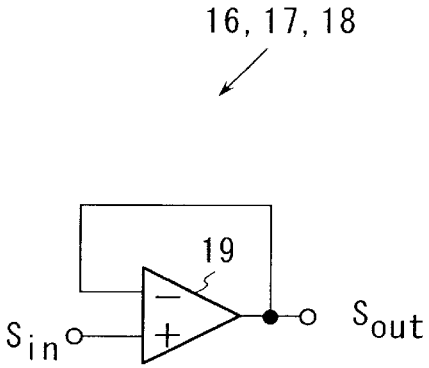
FIGS. 4A and 4B show buffers of the sample holder circuit 10.
Figure 4B:
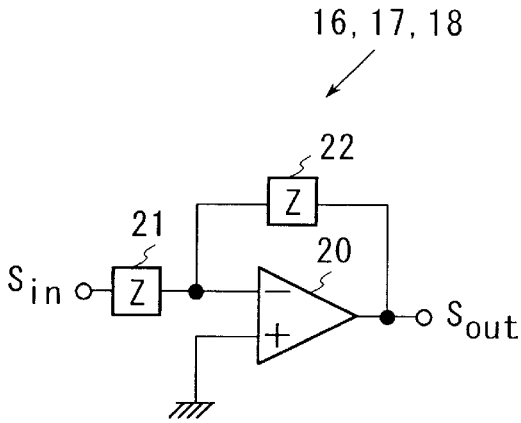

FIG. 4A shows an example of the buffers 16, 17 and 18, which are voltage follower circuits using an operation amplifier 19. FIG. 4B shows an alternate example of the buffers 16, 17 and 18, which have an operation amplifier 20, an input impedance element 21 and a feedback impedance element 22.

Figure 5:
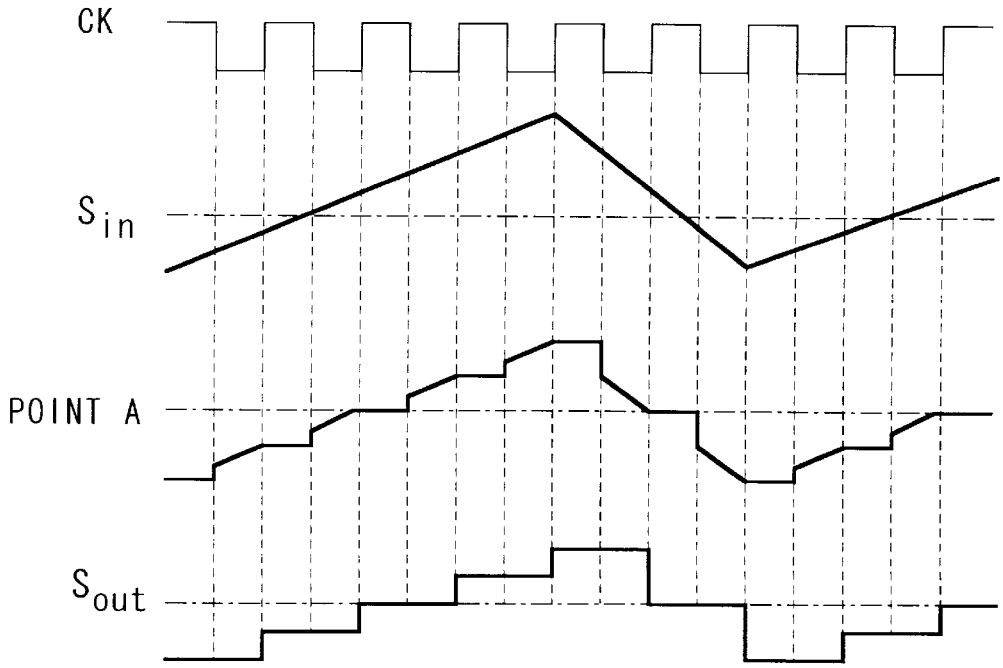
FIG. 5 is a time chart explaining the operation of the sample holder 45.

FIG. 5 shows the operation of the sample holder circuit 10-1. The input signal Sin is sampled in synchronization with the clock signal CK, and held in the capacitor 14. The electrical level of the point A in FIG. 3, which is the output level of the buffer 16, is indicated in the FIG. 5. The electrical level of the point A is further sampled by the later stage of the sample holder circuit 10-1 to be converted to the output signal Sout, which has discrete values.

Figure 6:
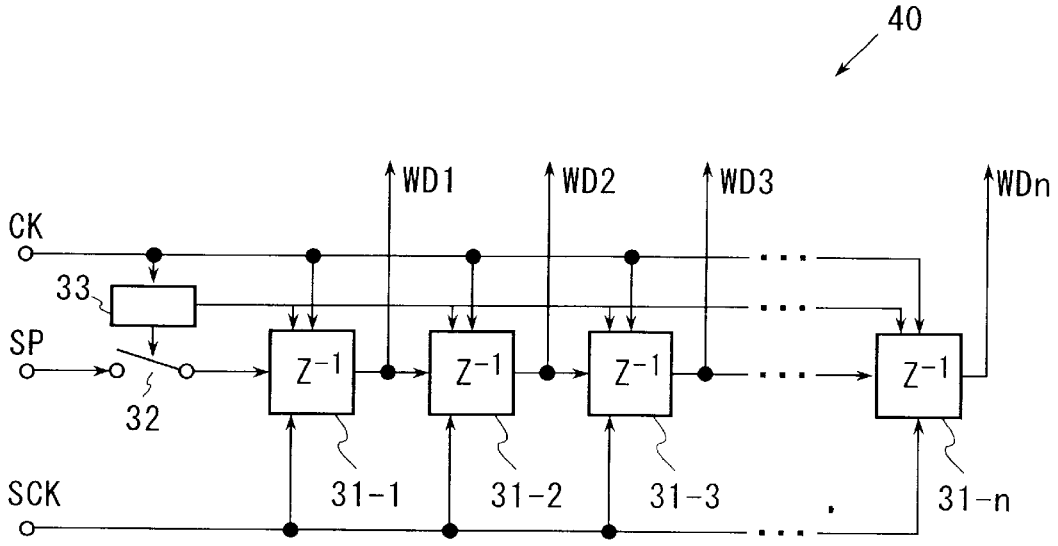
FIG. 6 is a construction of the delay unit 40 of the preferred embodiment.

FIG. 6 shows a construction of the delay unit 40. The delay unit 40 has the same number of delay circuits 31-1 through 31-n as the number of delayed values WD1 through WDn. A switch 32 provides the digital signal SP to the first delay circuit 31-1 in accordance with a control signal supplied by a switch controller 33, which operates in accordance with the sampling clock signal CK. The delay circuits 31-1 through 31-n shift the digital signal SP to the next delay circuit when the switch 32 is closed.

After all delay circuits 31-1 through 31-n hold the delayed values WD1 through WDn, the delayed values WD1 through WDn are shifted to the next delay circuits and output to the weighted addition circuit 50 in synchronization with the shift clock signal SCK. In other words, after the delayed values WD1 through WDn are kept in all the delay circuits 31-1 through 31-n in accordance with the sampling clock signal CK, the switch 32 is opened and the delayed values WD1 through WDn are shifted and output to the weighted addition circuit 50 in accordance with the shift clock signal SCK, which is 2×n times faster than the sampling clock signal CK.

The switch controller 33 controls the opening and closing of the switch 32 by counting the sampling clock signal CK. The switch controller 33 further controls the delay circuits 31-1 through 31-n to select either sampling clock signal CK or shift clock signal SCK for shifting the delayed values WD1 through WDn. After counting the sampling clock signal CK n times, the switch controller 33 opens the switch 32 and the delayed values WD1 through WDn are shifted to the next delay circuits and supplied to the weighted addition circuit 50 in accordance with the shift clock signal SCK. When the switch 32 is open, a value of ì0î is input to the first delay circuit 31-1 in accordance with the shift clock signal SCK.

The delay unit 40 repeats such shifting and supplying operations for all degrees of the autocorrelation coefficient, and the switch 32 closes again when the processes are completed for all degrees. The delay unit 40 repeats the shifting and sampling processes in accordance with the sampling clock signal CK and the shifting and supplying processes in accordance with the shift clock signal SCK.

The A/D converter 30 converts the input signal S to an m-bits digital signal SP. The number can be equal to 16, for example. In order to store all m bits of the digital signal SP, each delay circuit 31-1 through 31-n has a memory of m bits. These memories input the m-bit digital signal SP either in serial or in parallel, according to the signal format of the digital signal SP output from the A/D converter 30. The contents of the memories are updated each time the values of the next signal are supplied.

Figure 7:
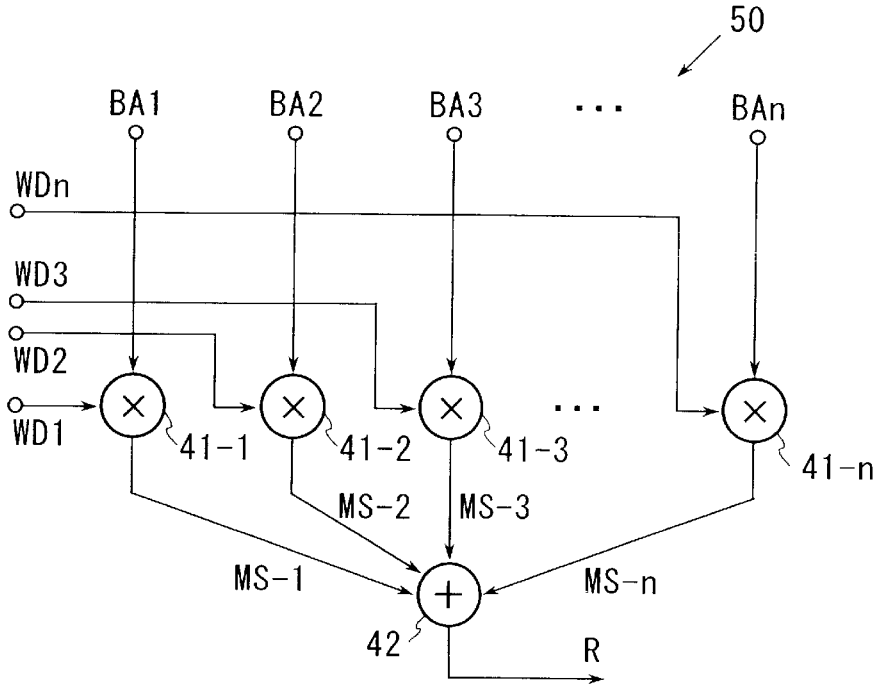
FIG. 7 is a construction of the weighted addition circuit 50 of the preferred embodiment.

FIG. 7 shows a construction of the weighted addition circuit 50. The weighted addition circuit 50 has n multipliers 41-1 through 41-n, and an adder 42. The multipliers 41-1 through 41-n multiply the delayed values WD1 through Wdn, as weight values, by the sampled values BA1 through BAn, respectively. The adder 42 adds the outputs of multipliers 41-1 through 41-n, and outputs the result as the autocorrelation coefficient R.

Figure 8:
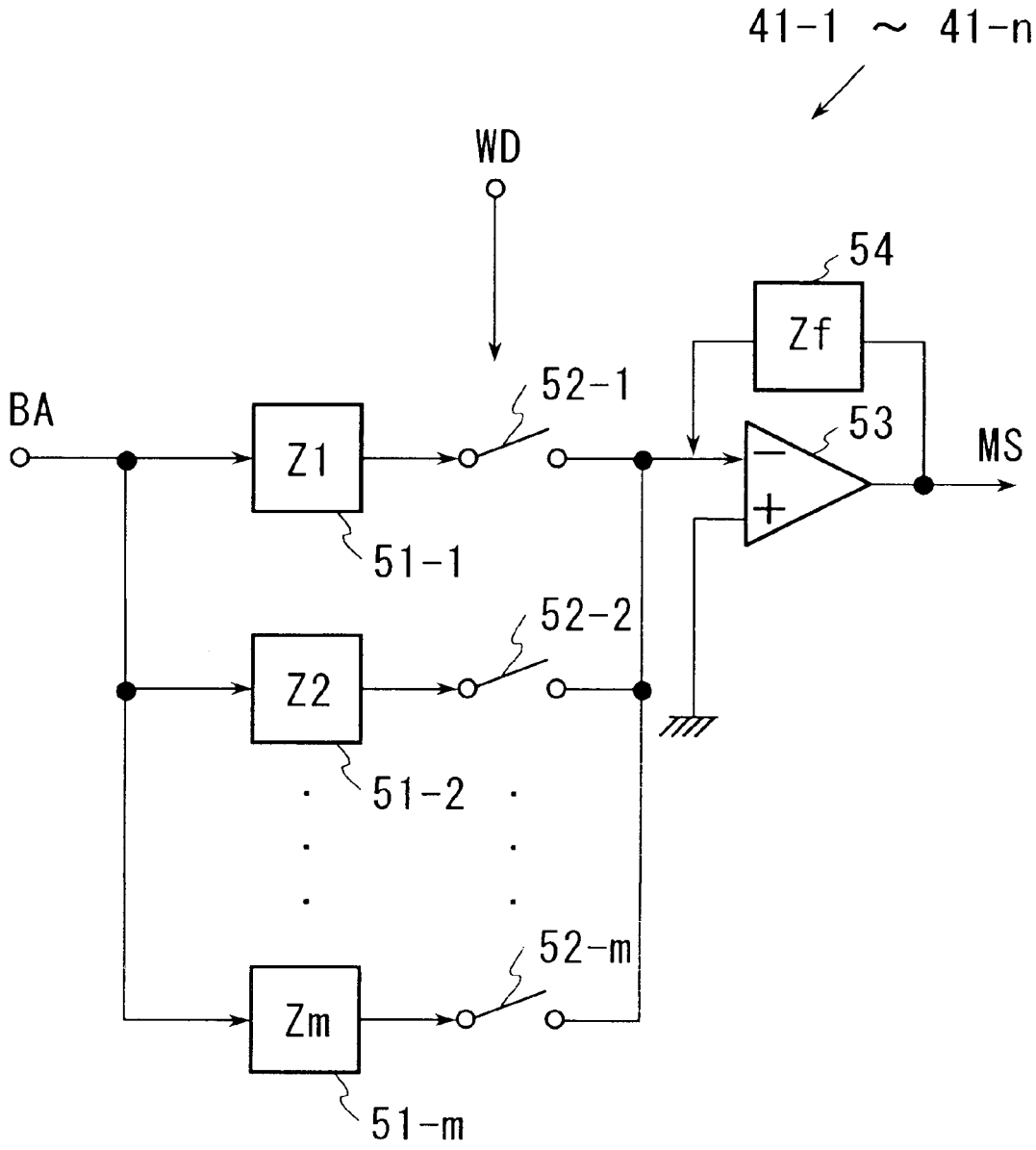
FIG. 8 is a construction of the multiplier 41 of the weighted addition circuit 50.

FIG. 8 shows a construction of the multipliers 41-1 through 41-n. The multipliers 41-1 through 41-n have impedance elements 51-1 through 51-m with impedance Zi (i=1, 2, . . . , m). The number of the impedance elements, m, can be 16 for example, and is set according to the accuracy required of the autocorrelation coefficient. The input BA, which is one of the sampled values BA1 through BAn, is supplied to the impedance elements 51-1 through 51-m in parallel, which are constructed with capacitors. A capacitor whose output is controlled by a higher bit (more significant bit) of the delayed value WD, has larger capacitance. The total impedance Zi of the impedance elements 51-1 through 51-m is expressed in formula (2) using the capacitance Ci (i=1,2, . . . , m) of the capacitors.

$$Zi=1/(j\omega Ci) \tag{2}$$

M switches 52-1 through 52-m are provided at the end of the impedance elements 51-1 through 51-m. The delayed value WD, which is one of the delayed values WD1 through WDn works as the weight values for the multiplication. Each bit of the delayed value WD controls the opening and closing of one of the switches 52-1 through 52-m, in parallel, to produce a total impedance of Zi. The output of the switches 52-1 through 52-m are input to the amplifier 53. The impedance value Zf of the feedback impedance element 54 is expressed by the formula (3). The gain G of this weighting circuit is expressed by formula (4).

$$Zf = 1/(j\omega\ Cf) \tag{3}$$

$$G = -\sum_i Ci/Cf \tag{4}$$

$$(i \in ON)$$

Figure 9:
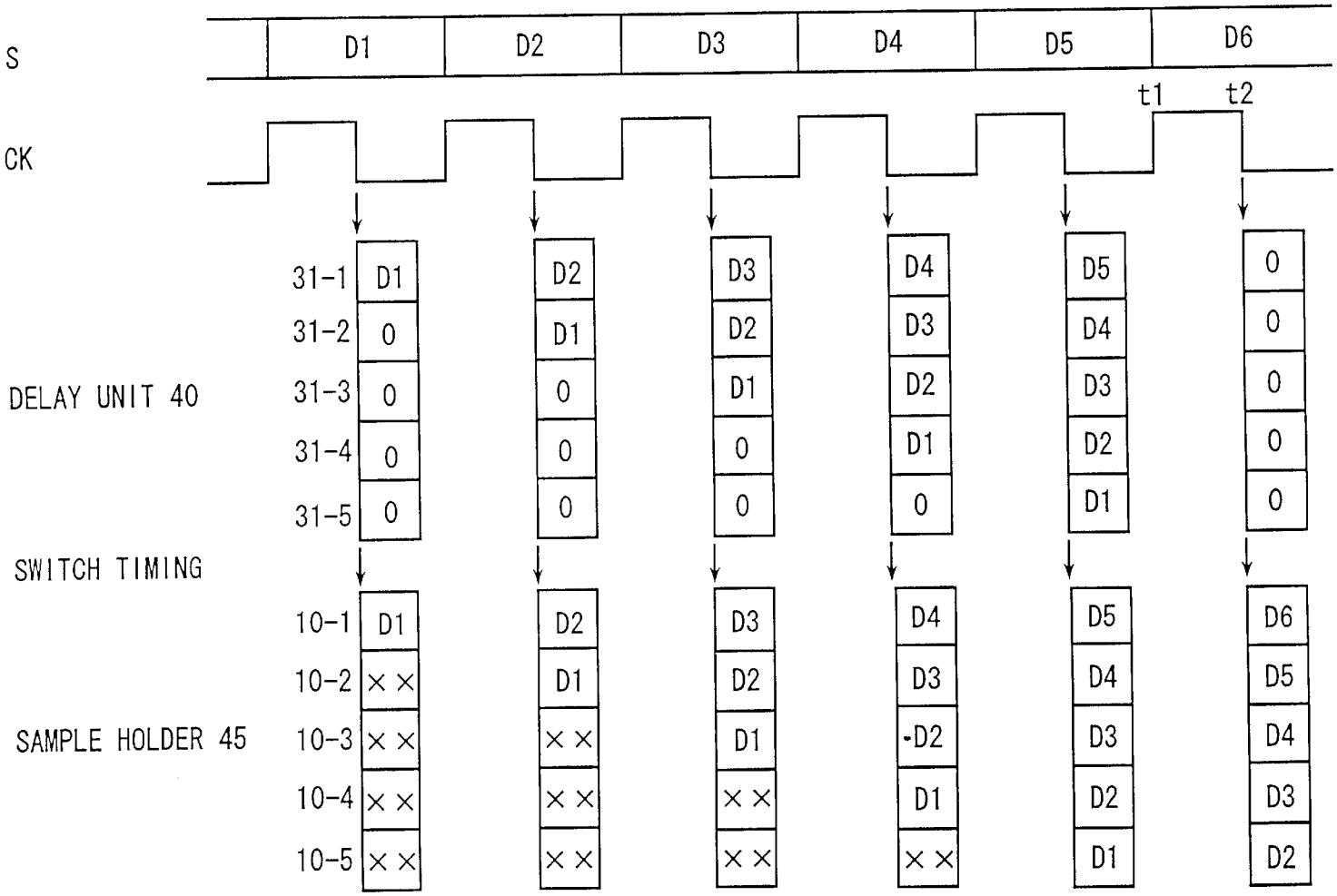
FIG. 9 is a time chart explaining the sampling process of the preferred embodiment.
Figure 10:
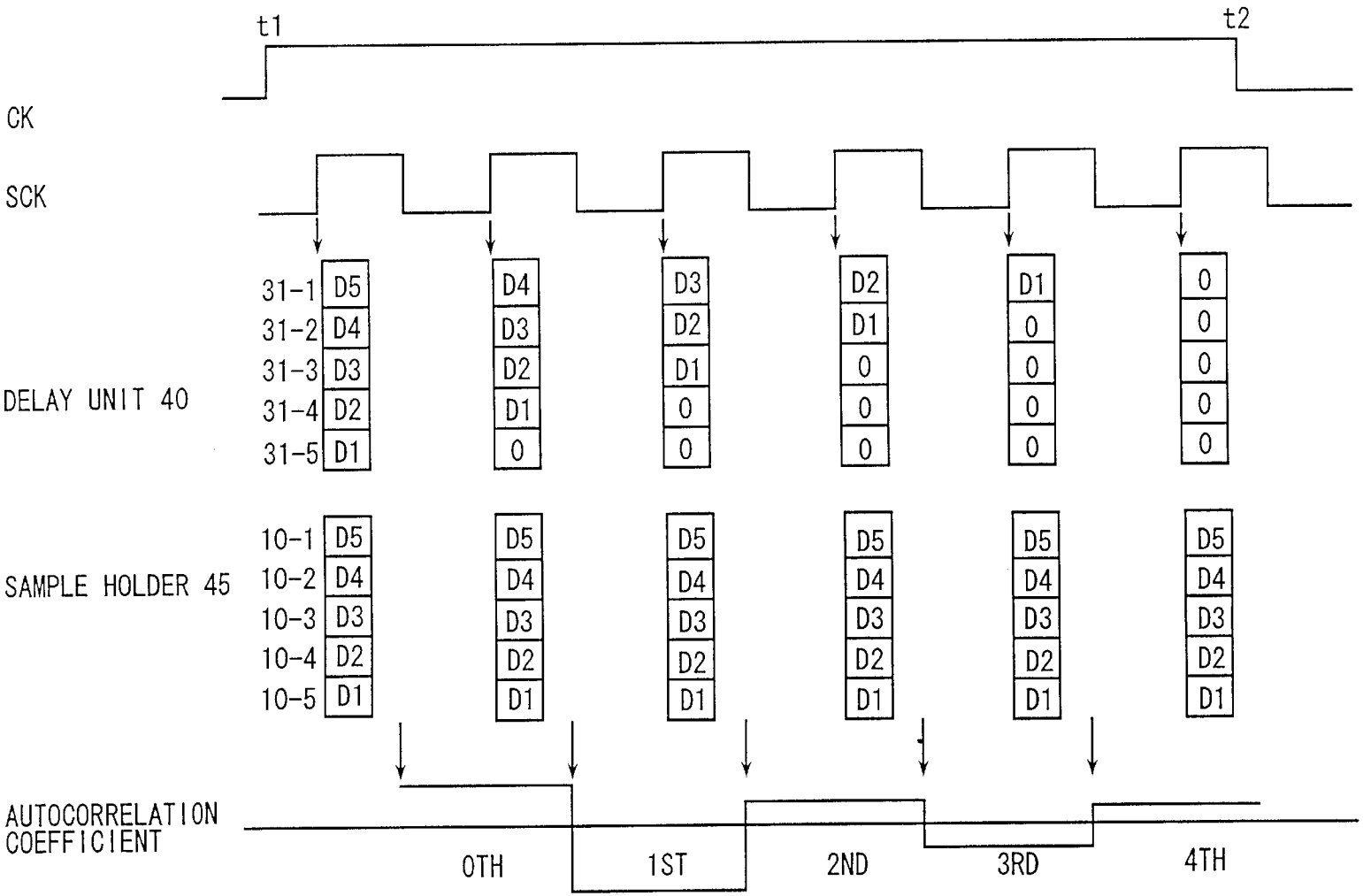
FIG. 10 is a time chart of the autocorrelation coefficient calculation according to the preferred embodiment of the present invention.

FIGS. 9 and 10 show the operation of the autocorrelation coefficient operator 60. In FIGS. 9 and 10, for simplicity, the autocorrelation coefficient operator 60 samples only five values of the input signal S, which are indicated as D1 through D5 in the drawings.

The values D1 through D5 are sampled from the input signal S and shifted to delay circuits 31-1 through 31-5 sequentially in synchronization with the sampling clock signal CK. The values D1 through D5 are also loaded to the sample holder circuits 10-1 through 10-5 sequentially. After all delay circuits 31-1 through 31-5 and sample holder circuits 10-1 through 10-5 hold the values D1 through D5, the values D1 through D5 are output to the weighted addition circuit 50 for the autocorrelation coefficient calculation, between time t1 and time t2.

FIG. 10 shows in detail the operation conducted between time t1 and time t2. The values D1 through D5 held by the delay circuits 31-1 through 31-5 of the delay unit 40 are shifted to the next delay circuits and output from the delay circuits 31-1 through 31-5 in synchrony with the shift clock signal SCK. The values output from the delay unit 40 are integrated with values D1 through D5 output from the sample holder circuits 10-1 through 10-5 at the same time.

Each of the 0th to 4th degree autocorrelation coefficients is calculated and output from the weighted addition circuit 50 in each cycle of the shift clock signal SCK. The 0th to 4th degree autocorrelation coefficients are calculated between time t1 and time t2 within one cycle of the sampling clock signal CK. Thus, the autocorrelation coefficient R can be calculated at high speed.

Although the present invention was explained using the example of audio signal processing, the scope of the invention should not be limited to such embodiments. Those skilled in the art could add various modifications to the present invention without departing from the scope of the invention, which is defined by the attached claims.

For example, the present invention can also be applied to other types of signal processing which use an autocorrelation coefficient. In any application, the present invention allows the autocorrelation coefficient to be calculated at high speed with low power consumption. When adapting the autocorrelation coefficient operator 60 of the present invention to mobile stations, it is preferable to construct the operator as a one-chip circuit.

As explained above, in the autocorrelation coefficient operator 60 of the present invention, the sample holder 45 outputs the sampled values at the same time when the number of sampled values it holds reaches a predetermined value. The delayed values held in the delay unit 40 are shifted sequentially and output at the same time. Every time the delay unit 40 outputs the delayed values, the weighted addition circuit 50 integrates the sampled values output from the sample holder 45 and the delayed values output from the delay unit 40, to calculate the autocorrelation coefficient. Therefore, the autocorrelation coefficient is calculated at high speed with small power consumption.

The autocorrelation coefficient operator of the present invention uses a capacitor for the impedance element. Thus, the power consumption is decreased even more, since less electrical power is converted to heat.

What is claimed is:

1. An autocorrelation coefficient operator for determining an autocorrelation coefficient of an input signal, comprising:

a delay unit for delaying the input signal and holding a delayed value;

a sample holder having a capacitor for sampling the input signal and holding a sampled value; and a weighted addition circuit for determining the autocorrelation coefficient by integrating the sampled value and the delayed value.

2. The autocorrelation coefficient operator according to claim 1 further comprising:

an analog-to-digital converter which converts the input signal to a digital signal; wherein the delay unit delays and holds the digital signal produced by the analog-to-digital converter.

3. The autocorrelation coefficient operator according to claim 2, wherein:

the sample holder samples the input signal in synchronization with the delay unit.

4. The autocorrelation coefficient operator according to claim 3, further comprising:

an operation timing controller for supplying a sampling clock signal to the sample holder and the delay unit, wherein the sample holder samples the input signal in accordance with the sampling clock signal; and the delay unit delays and holds the digital signal in synchronization with the sampling clock signal.

5. The autocorrelation coefficient operator according to claim 4, wherein:

the sample holder has a given number, n, of sample holder circuits, each of which includes the capacitor; and each of the capacitor holds a value of the input signal by sampling the input signal sequentially in accordance with the sampling clock signal.

6. The autocorrelation coefficient operator according to claim 5, wherein:

the delay unit has n delay circuits connected in series; and the delay circuits shift and hold the digital signals in synchronization with the sampling clock signal until coming to hold n delayed values.

7. The autocorrelation coefficient operator according to claim 6, wherein:

the weighted addition circuit determines the autocorrelation coefficient after the sample holder comes to hold n sampled values and the delay unit also comes to hold n delayed values.

8. The autocorrelation coefficient operator according to claim 7, wherein:

the operation timing controller causes the sample holder to output the sampled values after the sample holder comes to hold n sampled values, and causes the delay unit to output the delayed values after the delay unit comes to hold n delayed values.

9. The autocorrelation coefficient operator according to claim 8, wherein:

the operation-timing controller further supplies a shift clock signal to the delay unit;

the sample holder outputs the sampled values in accordance with the sampling clock signal after coming to hold n sampled values; and the delay unit outputs the delayed values in accordance with the shift clock signal after coming to hold n delayed values.

10. The autocorrelation coefficient operator according to claim 9, wherein:

the sampling clock signal and the shifting clock signal have first and second frequency, respectively; and the second frequency is higher than the first frequency.

11. The autocorrelation coefficient operator according to claim 9, wherein:

the sampling clock signal and the shifting clock signal have first and second frequency, respectively; and the second frequency is higher than a frequency produced by multiplying the first frequency by n.

12. The autocorrelation coefficient operator according to claim 9, wherein:

the sampling clock signal and the shifting clock signal have first and second frequency, respectively; and the second frequency is two times of the frequency produced by multiplying the first frequency by n.

13. The autocorrelation coefficient operator according to claim 5, wherein the sample holder circuit includes:

first and second switches which open and close in opposite directions from each other in accordance with the sampling clock signal;

first and second capacitors which hold fist and second signals supplied from the first and second switches, respectively; and a first buffer which supplies the first signal held in the first capacitor to the second switch; and a second buffer which outputs the second signal held in the second capacitor, as the sampled value.

14. The autocorrelation coefficient operator according to claim 13, wherein:

the weighted addition circuit has a plurality of multipliers and an adder, each of the multipliers has a given number, m, of impedance elements for receiving the sampled value in parallel, an amplifier having an input and an output, m switches each of which is provided between one of the impedance element and the input of the amplifier and controlled by the delayed value, and a feedback impedance element provided between the input and the output of the amplifier; and the adder adds the outputs of the multipliers.

15. The autocorrelation coefficient operator according to claim 14, wherein:

the weighted addition circuit has n multipliers for receiving n sampled values and n delayed values.

16. The analog-to-digital converter converts according to claim 14, wherein:

the analog-to-digital converter converts the input signal to the digital signal of m-bit binary data; and each of the m switches of the multiplier is controlled by one of the m bits.

17. The autocorrelation coefficient operator according to claim 14, wherein:

larger capacitance is given to the impedance element connected to the switch which is controlled by higher bit of the m-bit.

* * * * *